US007918373B2

(12) United States Patent
Ohmori

(10) Patent No.: US 7,918,373 B2
(45) Date of Patent: Apr. 5, 2011

(54) COMBUSTION TYPE POWER TOOL

(75) Inventor: Yasuki Ohmori, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 284 days.

(21) Appl. No.: 12/282,010

(22) PCT Filed: Mar. 8, 2007

(86) PCT No.: PCT/JP2007/055157
§ 371 (c)(1),
(2), (4) Date: Sep. 8, 2008

(87) PCT Pub. No.: WO2007/102622
PCT Pub. Date: Sep. 13, 2007

(65) Prior Publication Data

US 2009/0090760 A1 Apr. 9, 2009

(30) Foreign Application Priority Data

Mar. 8, 2006 (JP) ..... 2006-062623

(51) Int. Cl.
*B25C 1/08* (2006.01)

(52) U.S. Cl. ..... 227/8; 227/10; 227/130; 123/46 SC

(58) Field of Classification Search ..... 227/8, 10, 227/130; 123/46 SC
See application file for complete search history.

(56) References Cited

U.S. PATENT DOCUMENTS

| | | | | |
|---|---|---|---|---|
| 4,629,106 | A * | 12/1986 | Howard et al. | 227/8 |
| 5,197,646 | A * | 3/1993 | Nikolich | 227/8 |
| 5,485,946 | A * | 1/1996 | Jankel | 227/8 |
| 5,909,836 | A * | 6/1999 | Shkolnikov et al. | 227/8 |
| 6,223,963 | B1 * | 5/2001 | Aparacio, Jr. | 227/8 |
| 6,715,655 | B1 | 4/2004 | Taylor et al. | |
| 6,722,550 | B1 * | 4/2004 | Ricordi et al. | 123/46 SC |
| 6,739,490 | B1 * | 5/2004 | Shkolnikov et al. | 227/2 |
| 6,983,871 | B2 * | 1/2006 | Shima et al. | 227/8 |
| 2005/0029323 | A1 | 2/2005 | Shima et al. | |
| 2005/0173484 | A1 | 8/2005 | Moeller et al. | |

FOREIGN PATENT DOCUMENTS

| | | |
|---|---|---|
| JP | 64-009149 | 1/1989 |
| JP | 64-034753 | 2/1989 |
| JP | 03-025307 | 2/1991 |
| JP | 04-011337 | 1/1992 |
| JP | 04-048589 | 2/1992 |
| JP | 07-036985 | 2/1995 |
| JP | 1 053 834 A2 | 11/2000 |

* cited by examiner

*Primary Examiner* — Scott A. Smith
(74) *Attorney, Agent, or Firm* — Antonelli, Terry, Stout & Kraus, LLP.

(57) ABSTRACT

A combustion type power tool capable of avoiding wasteful injection of combustible gas from a gas canister even if an unintentional operation of the push lever takes place, and capable of avoiding wasteful electric power consumption even if a battery used as power supply remains set in the tool. While the tool is not being used, a stop unit is set at a stop position, preventing a gas canister from injecting gas, and while the tool is being used, the stop unit is set at a release position, allowing the gas canister to inject gas as a result of movement of a combustion chamber frame.

10 Claims, 4 Drawing Sheets

COMBUSTION TYPE POWER TOOL

TECHNICAL FIELD

The present invention relates to a combustion type power tool, and more particularly, to a type thereof in which liquefied gas filled in a gas canister is injected into a combustion chamber, mixed with air and ignited, thereby generating driving force for moving a piston to drive fasteners such as nails, rivets and staples and the like.

BACKGROUND ART

As shown in FIG. 4, a portable combustion type power tool 90 generally includes a housing 2, a cylinder 20, a piston 25, a driver blade 28, a chamber head 13, a combustion chamber frame 11, a canister housing 49, a fan 14, an ignition plug 15, and a trigger switch 6. The housing 2 contains various components. The cylinder 20 is provided in the housing 2. The piston 25 is slidably movable in the cylinder 20 in an axial direction thereof. The driver blade 28 is fixed to the piston 25 and drives fasteners into a workpiece W as the piston 25 moves. The chamber head 13 is spaced from an end of the cylinder 20, and is secured to the housing 2. The combustion chamber frame 11 is provided in the housing 2 and is movable in the axial direction while sliding on an outer circumferential surface of the cylinder 20. The combustion chamber frame 11 is contactable with the chamber head 13 in accordance with the axial movement to provide a combustion chamber 26 in combination with the chamber head 13 and piston 25. The canister housing 49 is provided in the housing 2 and is adapted for containing a gas canister 5. A gas injection port 18 is formed in the chamber head 13 for injecting a combustible gas from the gas canister 5 into the combustion chamber 26. The fan 14 is provided in the combustion chamber 26. The ignition plug 15 ignites the mixture of air and the combustible gas injected into the combustion chamber 26 through the gas injection port 18. The trigger switch 6 is secured to the housing 2.

The combustion type power tool 90 further includes an ignition control device 110 (see FIG. 5). As shown in FIG. 5, the ignition control device 110 includes a control circuit 102 electrically connected to the trigger switch 6. The control circuit 102 transmits a driving signal to the ignition plug 15 for generating a spark thereat when the trigger switch 6 is operated. As shown in a block diagram of FIG. 5, in the ignition control device 110, a secondary battery 100 such as a nickel-cadmium battery supplies power, and the trigger switch 6 and a head switch 101 transmit an on-signal and an off-signal to the control circuit 102. The control circuit 102 is also adapted to control a fan driver circuit 103 and an ignition circuit 104 and to drive a display circuit 105.

In the combustion type power tool 90, nail driving depth into the workpiece can be adjusted by a protruding length of a push lever 10 protruding from a nail-driving port of a tail cover 9 that is provided below the cylinder 20. When the push lever 10 is pushed onto the workpiece W, a coupling member 12 moves in interlocking relation to the movement of the push lever 10, so that the coupling member 12 pushes the combustion chamber frame 11 upwards. As a result, the combustion chamber frame 11 abuts on the chamber head 13, whereupon the combustion chamber 26 is sealed from outside.

In synchronism with the movement of the coupling member 12, a pushing means including a projecting member 16 and an L-shaped lever 50 is also moved. That is, the projecting member 16 moves in synchronism with the movement of the coupling member 12, so that the L-shaped lever 50 is pivotally moved to push the injection nozzle (injection rod) 39 of the gas canister 5 set in the canister housing 49. The combustible gas is thus injected from the injection nozzle 39 into the combustion chamber 26. In the combustion chamber 26, the combustible gas is stirred by the fan 14 driven by a control circuit 102 and a fan driver circuit 103, both shown in FIG. 5. The combustible gas is therefore mixed with air, forming air-fuel mixture. In this condition, the control circuit 102 and an ignition circuit 104, both shown in FIG. 5, are operated, causing the ignition plug 15 to generate a spark in the combustion chamber 26. The air-fuel mixture is combusted in the combustion chamber 26, generating a force that can drive fasteners, such as nails, into the workpiece.

The combustion type power tool 90 need not have a compressor, unlike conventional nail gun that uses compressed air as a drive source. The power tool 90 can therefore be transported to a construction site more easily than the conventional nail gun. In addition, since the power tool 90 has a built-in power supply such as a secondary battery, the power tool 90 requires no other power supplies including the commercially available power supply. Therefore, the power tool 90 is advantageous in operability among a portable tool.

The above-described combustion type power tool is disclosed in, for example, Japanese Patent Publication Nos. H01-34753, H04-48589, H03-25307, H04-11337, S64-9149, and H07-36985.

In the above-described conventional combustion type power tool 90, the gas canister 5 detachably held in the canister housing 49 is usually still retained in the canister housing 49 even after the end of a work at a working place such as a construction site. If the push lever 10 is unintentionally or accidentally operated while the gas canister 5 remains set in the tool 90, the push lever 10 will move upwards because the lever 10 is merely biased by a coil spring 37. As the push lever 10 moves, the coupling member 12 coupled to the push lever 10 drives the pushing means including the link member such as the lever 50 and the like, via the combustion chamber frame 11. Consequently, the injection nozzle 39 of the gas canister 5 is pushed, and the combustible gas is unnecessarily injected into the combustion chamber 26. The combustible gas is inevitably wasted. In addition, particular attention must be drawn to accidental ignition of the combustible gas thus injected wastefully.

While the combustion type power tool 90 is left unused, electric power is supplied to the ignition control device 110 (see FIG. 5) even if no unintentional operation of the push lever 10 takes place, as long as the battery 100 remains set in the power tool 90. That is, the control current flows at all times to monitor the on- or off-state of the trigger switch 6 and head switch 101. In this case, the electric power is wasted.

Therefore, the gas canister 5 and the battery 100 must be removed from the tool 90 after the end of work. However, pulling the battery (battery pack) from the tool every time the work is ended is cumbersome. In many cases, the worker lefts the battery set in the tool. If the battery remains in the tool for a long time while the tool remains unused, the battery voltage will be dropped due to discharge, particularly in an ordinary battery such as a nickel-cadmium battery. As a result, the tool may not be driven when necessary. Further, a service life of the battery will be shortened if the battery is fully discharged or over-discharged. In the latter case, the battery must be replaced by a new battery.

DISCLOSURE OF INVENTION

It is therefore an object of the present invention is to provide a combustion type power tool capable of avoiding wasteful injection of combustible gas from the gas canister even if an unintentional operation of the push lever takes place while the gas canister remains set in the tool.

Another object of the invention is to provide a combustion type power tool capable of avoiding wasteful injection of combustible gas from the gas canister based on an unintentional operation of the push lever, and at the same time, capable of avoiding wasteful electric power consumption even if a battery used as power supply remains set in the tool.

These and other objects of the present invention will be attained by a combustion type power tool including a housing, a push lever, a combustion chamber frame, a drive mechanism and a prohibiting mechanism. The housing includes a canister housing in which a gas canister accumulating therein a gas is provided. The push lever is supported to the housing. The combustion chamber frame is disposed in the housing and is movable in accordance with a movement of the push lever. The drive mechanism is provided in the housing for driving the gas canister to inject the gas when the combustion chamber frame is moved to a predetermined position. The prohibiting mechanism is disposed at the housing and selectively provides a prohibiting phase to prevent the combustion chamber frame from moving past the predetermined position and a non-prohibiting phase to allow the combustion chamber frame to move past the predetermined position.

When the prohibiting mechanism provides the prohibiting phase, the combustion chamber frame cannot be moved past the predetermined position, and therefore, the drive mechanism cannot drive the gas canister to its gas injection phase. Hence, even if the gas canister remains set in the canister housing, while the tool is not being used, gas is not wastefully consumed when the push lever is unintentionally operated as long as the prohibiting mechanism is at the prohibiting phase. This saves resources and enhances safety. Further, the operability of the tool can be increased because the gas canister need not be removed from the tool after using the tool.

Preferably, the push lever is movable in a first direction toward a workpiece and a second direction opposite to the first direction. The combustion type power tool further includes a chamber head, a cylinder, a piston, and a coupling member. The chamber head forms therein a gas injection passage. The gas canister is in selective fluid communication with the gas injection passage. The cylinder is disposed in the housing and below the chamber head and extends in a longitudinal direction of the housing. The piston is slidably movably disposed in the cylinder. A combustion chamber is defined in combination with the combustion chamber frame, the chamber head, the cylinder and the piston when the combustion chamber frame is seated on the chamber head through the movement of the combustion chamber in the second direction. The coupling member connects the push lever to the combustion chamber frame for moving the combustion chamber frame to a position in abutment with the chamber head in interlocking relation to the movement of the push lever into the housing.

Preferably, the prohibiting mechanism has a stop position in the prohibiting phase to prevent the coupling member from moving in the second direction, and has a release position in the non-prohibiting phase to allow the coupling member to move in the second direction.

Preferably, the prohibiting mechanism includes a projection part and a lever part. The projection part is pivotally supported to the housing and is movable between a projecting position abutable on the coupling member and retracted position away from the coupling member. The lever part is connected to the projection part and is accessible by a user for pivotally moving the projection part between the projecting position and the retracted position.

Preferably, the drive mechanism includes a projection member and an L-shaped lever. The projection member extends from the combustion chamber frame toward the chamber head. The projection member is movable in the first direction and second direction in accordance with the movement of the combustion chamber frame. The L-shaped lever is pivotally movably supported to the housing and has a first arm for urging the gas canister to a position of the gas injection phase and a second arm integral with the first arm and associated with the projection member. The projection member is maintained away from the second arm when the prohibiting mechanism has the stop position, and is abutable on the second arm when the prohibiting mechanism has the release position.

Preferably, the push lever is movable in a first direction toward a workpiece and a second direction opposite to the first direction. The combustion type power tool further includes a chamber head, an ignition plug, an ignition control circuit, and an interlocking mechanism. The chamber head forms therein a gas injection passage. The gas canister is in selective fluid communication with the gas injection passage. A combustion chamber is defined when the combustion chamber frame is seated on the chamber head through the movement of the combustion chamber in the second direction. The ignition plug is supported in the chamber head for igniting a combustible gas injected from the gas canister into the combustion chamber. The ignition control circuit is connected to the ignition plug and includes a power switch and a power source section. The interlocking mechanism is connected between the prohibiting mechanism and the power switch for maintaining the power switch in OFF state in interlocking relation to the prohibiting phase.

In another aspect of the present invention, there is provided a combustion type power tool including a housing, a push lever, a combustion chamber frame, a chamber head, an ignition plug, an ignition control circuit, a prohibiting mechanism and an interlocking mechanism. The housing includes a canister housing in which a gas canister is provided. The push lever is supported in the housing and is movable in a first direction toward a workpiece and a second direction opposite to the first direction. The combustion chamber frame is disposed in the housing and is movable in the first direction and the second direction in accordance with a movement of the push lever. The chamber head forms therein a gas injection passage. The gas canister is in selective fluid communication with the gas injection passage. A combustion chamber is defined when the combustion chamber frame is seated on the chamber head through the movement of the combustion chamber frame in the second direction. The ignition plug is supported in the chamber head for igniting a combustible gas injected from the gas canister into the combustion chamber. The ignition control circuit is connected to the ignition plug and includes a power switch and a power source section. The prohibiting mechanism is disposed at the housing and selectively provides a prohibiting phase to prevent the combustion chamber frame from moving past a predetermined position through the movement of the combustion chamber frame in the second direction and a non-prohibiting phase to allow the combustion chamber frame to move past the predetermined position through the movement of the combustion chamber frame in the second direction. The interlocking mechanism is connected between the prohibiting mechanism and the power switch for maintaining the power switch in OFF state in interlocking relation to the prohibiting phase.

The power switch can be turned on to supply electric power from the power source to the ignition control circuit and turned off to shut off the power supply. Here, no electric power is supplied to the ignition control device as long as the prohibiting mechanism remains at the prohibiting phase even if the power source such as a battery remains set in the power tool while the tool remains unused. Thus, no control current is supplied even if the push lever is unintentionally operated. This avoids wasteful consumption of power source and, ultimately, saves resources and enhances safety. In addition, troublesome work such as setting the battery before using the tool or removing the same after using the tool can be avoided. Moreover, over-discharging of the battery can be prevented, and the lifetime of the battery can therefore be prolonged.

Figure 1:
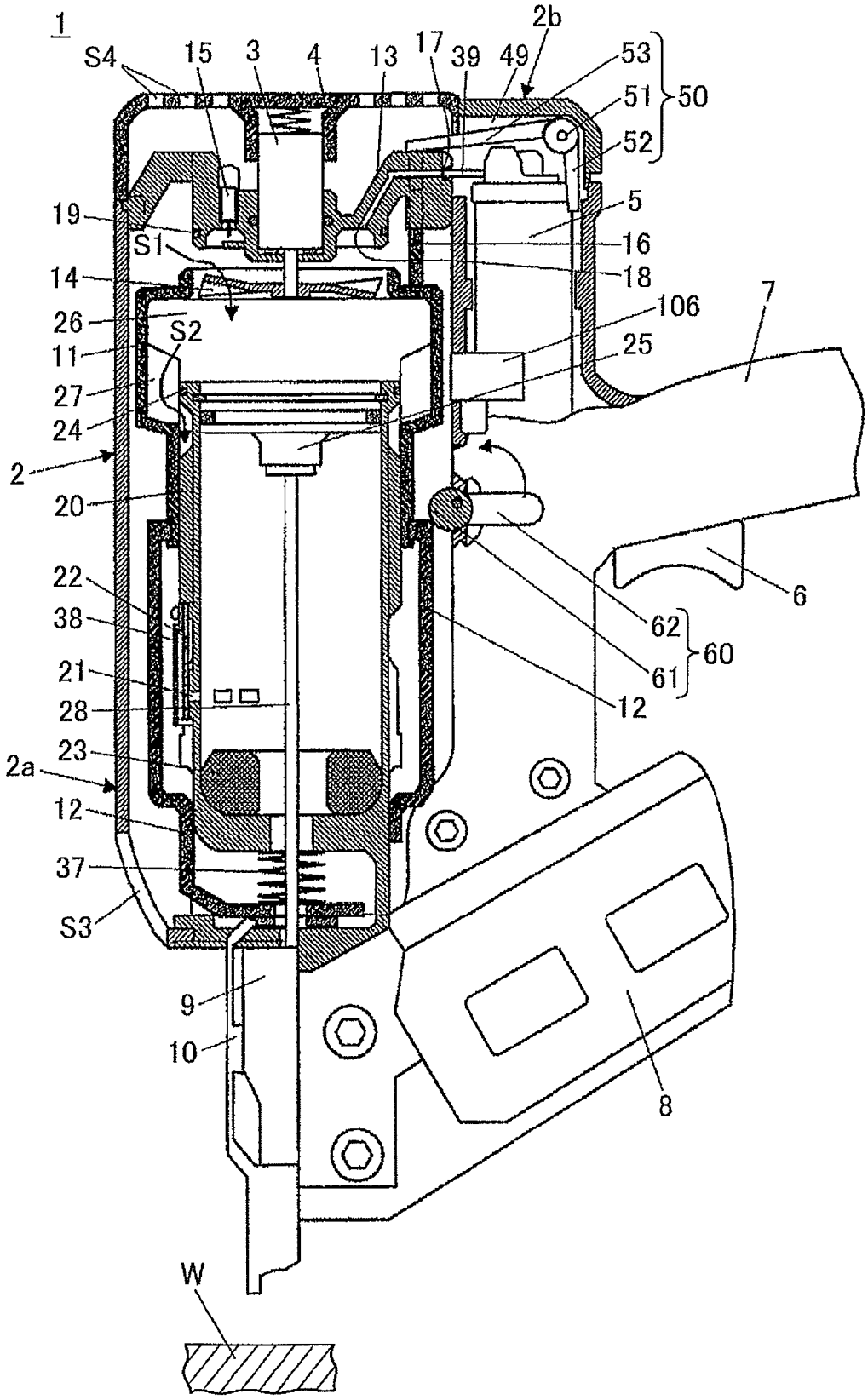
FIG. 1 is a schematic cross-sectional view of a combustion type power tool according to an embodiment of the present invention, showing an initial state where a stop unit is held in a stop position.

| DESCRIPTION OF REFERENCE NUMERALS | |
|---|---|
| 1 | combustion type power tool |
| 2 | housing |
| 2a | main housing section |
| 2b | canister housing section |
| 3 | fan motor |
| 4 | head cover |
| 5 | gas canister (fuel cell) |
| 6 | trigger switch |
| 7 | handle |
| 8 | magazine |
| 9 | tail cover |
| 10 | push lever |
| 11 | combustion chamber frame |
| 12 | coupling member |
| 13 | chamber head |
| 14 | fan |
| 15 | ignition plug |
| 16 | projecting member |
| 17 | nozzle receptacle |
| 18 | injection port |
| 19 | first seal member |
| 20 | cylinder |
| 21 | gas vent hole |
| 22 | exhaust gas check valve |
| 23 | bumper |
| 24 | second seal member |
| 25 | piston |
| 26 | combustion chamber |
| 27 | rib |
| 28 | driver blade |
| 37 | compression coil spring |
| 38 | exhaust cover |
| 39 | injection nozzle |
| 49 | canister housing |
| 50 | L-shaped lever |
| 51 | pivot shaft |
| 52 | first arm |
| 53 | second arm |
| 60 | stop unit |
| 61 | projection part |
| 62 | lever part |

-continued

| DESCRIPTION OF REFERENCE NUMERALS | |
|---|---|
| 100 | battery |
| 101 | head switch |
| 102 | control circuit |
| 103 | fan driver circuit |
| 104 | ignition circuit |
| 106 | power switch |
| 110 | ignition control circuit |
| S1 | first flow passage |
| S2 | second flow passage |
| S3 | exhaust gas opening |
| S4 | intake opening |

BEST MODE FOR CARRYING OUT THE INVENTION

Figure 5:
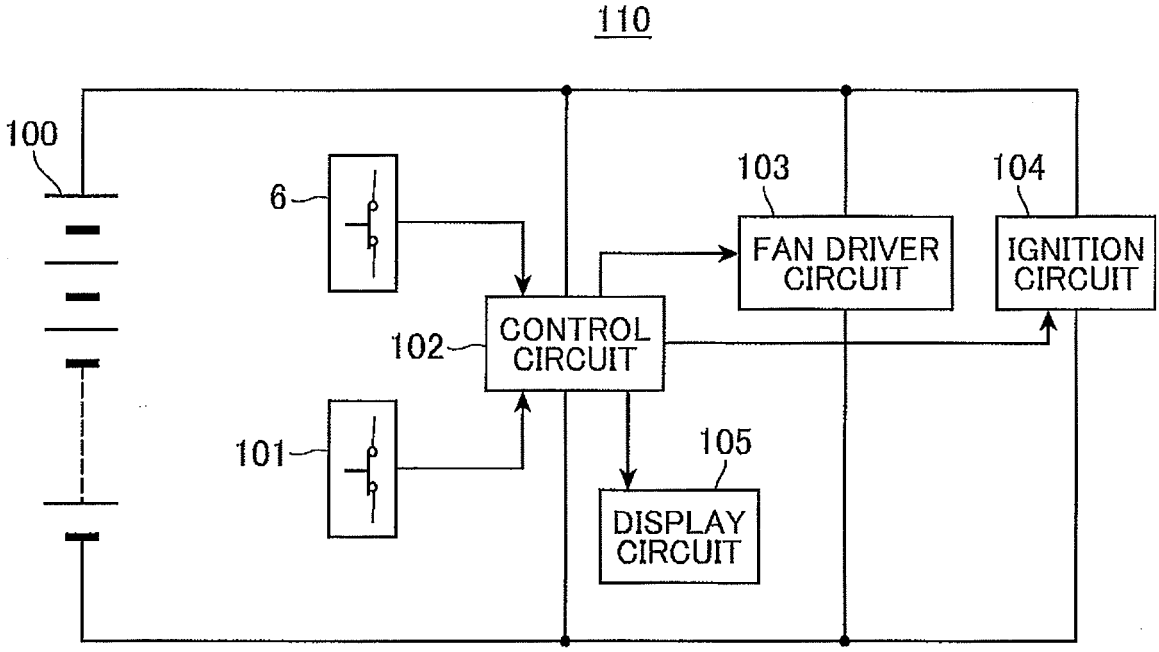
FIG.5 PRIOR ART
FIG. 5 is a block diagram of an ignition control device used in the conventional combustion type power tool.

A combustion type power tool according to one embodiment of the present invention will be described with reference to FIGS. 1 through 3. In the drawings like parts and components are designated by the same reference numbers and will not be described repeatedly. Similarly, the components identical in function to those of the conventional combustion type power tool shown in FIG. 4 and FIG. 5 are designated by the same reference numbers. Further, the direction in which nails (fasteners) are driven by the combustion type power tool will be referred to as "lower" or "lower portion", and the direction opposite to this direction will be referred to as "upper" or "upper portion" for the sake of convenience. The embodiment pertains to a nail gun that is one of the typical examples of the combustion type power tool.

An overall configuration of nail gun 1 will be described. As shown in FIG. 1, a nail gun 1 includes a housing 2 that constitutes an outer frame. The housing 2 includes a main housing section 2*a* in which various components such as a cylinder 20 (described later) are disposed. A handle 7 serving as a grip of the nail gun 1 is provided on a side of the main housing section 2*a*. A trigger switch 6 is provided to the handle 7. The main housing section 2*a* and the handle 7 define a canister housing section 2*b* for accommodating a gas canister 5 as a fuel cell. The tool 1 has a magazine 8 secured to the lower end portion of the main housing section 2*a* and the handle 7 for holding nails (fasteners, not shown). A tail cover 9 is provided to the lower end portion of the main housing section 2*a* for setting each nail supplied from the magazine 8 at a predetermined position.

A head cover 4 is attached to the upper end of the main housing section 2*a*. The main housing section 2*a* accommodates therein the cylinder 20, a chamber head 13, an ignition plug 15, a fan motor 3, a fan 14, a combustion chamber frame 11, a piston 25, a driver blade 28, and a bumper 23. The cylinder 20 extends in a longitudinal direction of the main housing section 2*a*.

The chamber head 13 is fixed to the end of the main housing 2*a* and is positioned above an upper open end of the cylinder 20. The chamber head 13 is formed with an injection passage having one end serving as an injection port 18 for ejecting combustible gas therethrough and another end serving as a nozzle receptacle 17. The ignition plug 15 is secured to the chamber head 13. The fan motor 3 is supported by the head cover 4 and the chamber head 13, and the fan 14 is fixed to the fan motor 3. More specifically, the chamber head 13 has a fan motor support region and an ignition plug support region. A motor shaft of the fan motor 3 extends through the fan motor support region, and the fan 14 is connected to the motor shaft.

The ignition plug 15 is adapted for generating a spark when the trigger switch 6 on the handle 7 is operated. Further, the chamber head 13 is formed with a through-hole through which a projection lever 16 (described later) is axially movably extends.

The combustion chamber frame 11 is movable toward and away from the chamber head 13 while sliding on an outer peripheral surface of the cylinder 20, and is abutable on the chamber head 13. The piston 25 is slidably reciprocally movable within the cylinder 20. The driver blade 28 is integrally formed with the piston 25 and extends toward the tail cover 9 for striking a nail (not shown) set in the tail cover 9 as the piston 25 moves downward. The bumper 23 is positioned above the lowermost end of the cylinder 20 for allowing the piston 25 to hit against the bumper 23 in order to absorb an excessive impact that is generated when the piston 25 moves toward its lower dead center.

The canister housing section 2*b* defines a canister housing 49 including a partition that surrounds the gas canister 5 in contact therewith so that the gas canister 5 can be detachably set. The nozzle receptacle 17 is positioned at an upper portion of the canister housing 49 for receiving an injection nozzle 39 of the gas canister 5.

Further, the projecting member 16 extends from an upper end of the combustion chamber frame 11 and extends through the through-hole formed in the chamber head 13. The through-hole is located near the canister housing 49. At the upper portion of the canister housing 49, an L-shaped lever 50 is provided. The L-shaped lever 50 is pivotally movably supported to the canister housing section 2*b* by a pivot shaft 51 and includes a first arm 52 and a second arm 53. The first arm 52 abuts on an outer peripheral side of the gas canister 5 at a diametrically opposite side of the injection nozzle 39. The second arm 53 is abutable on a free end of the projecting member 16. The projecting member 16 and the L-shaped lever 50 serving as a pushing mechanism and cooperate to push the injection nozzle 39 of the gas canister 5 against the nozzle receptacle 17.

The gas canister 5 contains compressed liquefied combustible gas. The gas evaporates when the gas is released into an atmosphere. A valve mechanism (not shown) is provided at the upper end of the gas canister 5 for adjusting a flow rate of the combustible gas flowing through the injection nozzle 39. When the pushing mechanism including the projecting member 16 and L-shaped lever 50 pushes the gas canister 5 toward the nozzle receptacle 17, a prescribed amount of the combustible gas can be injected toward the injection port 18 of the chamber head 13. The gas canister 5 is commercially available as a fuel cell for combustion type power tools.

A head switch 101 (FIG. 3) is provided in the main housing section 2*a* at a position near the chamber head 13 for detecting the combustion chamber frame 11 when the combustion chamber frame 11 is moved to a position in the vicinity of its uppermost stroke end position as the entire nail gun 1 is pushed against a workpiece W. When the combustion chamber frame 11 further rises beyond a predetermined position where the frame 11 pushes the gas canister 5 by way of the push lever 50, the head switch 101 is turned on, supplying a drive current to the motor 3. Thus, the fan 14 starts rotation.

At the lower end of the main housing section 2*a*, or below the lower end of the cylinder 20, a push lever 10 is supported at the position corresponding to a nail setting position in the tail cover 9. The push lever 10 is movable up and down along the outer peripheral surface of the tail cover 9. The push lever 10 is connected to the combustion chamber frame 11 through a coupling member 12. A compression coil spring 37 is interposed between the coupling member 12 and the cylinder 20 for biasing the push lever 10 and the coupling member 12 downwards at a position below the cylinder 20.

Figure 2:
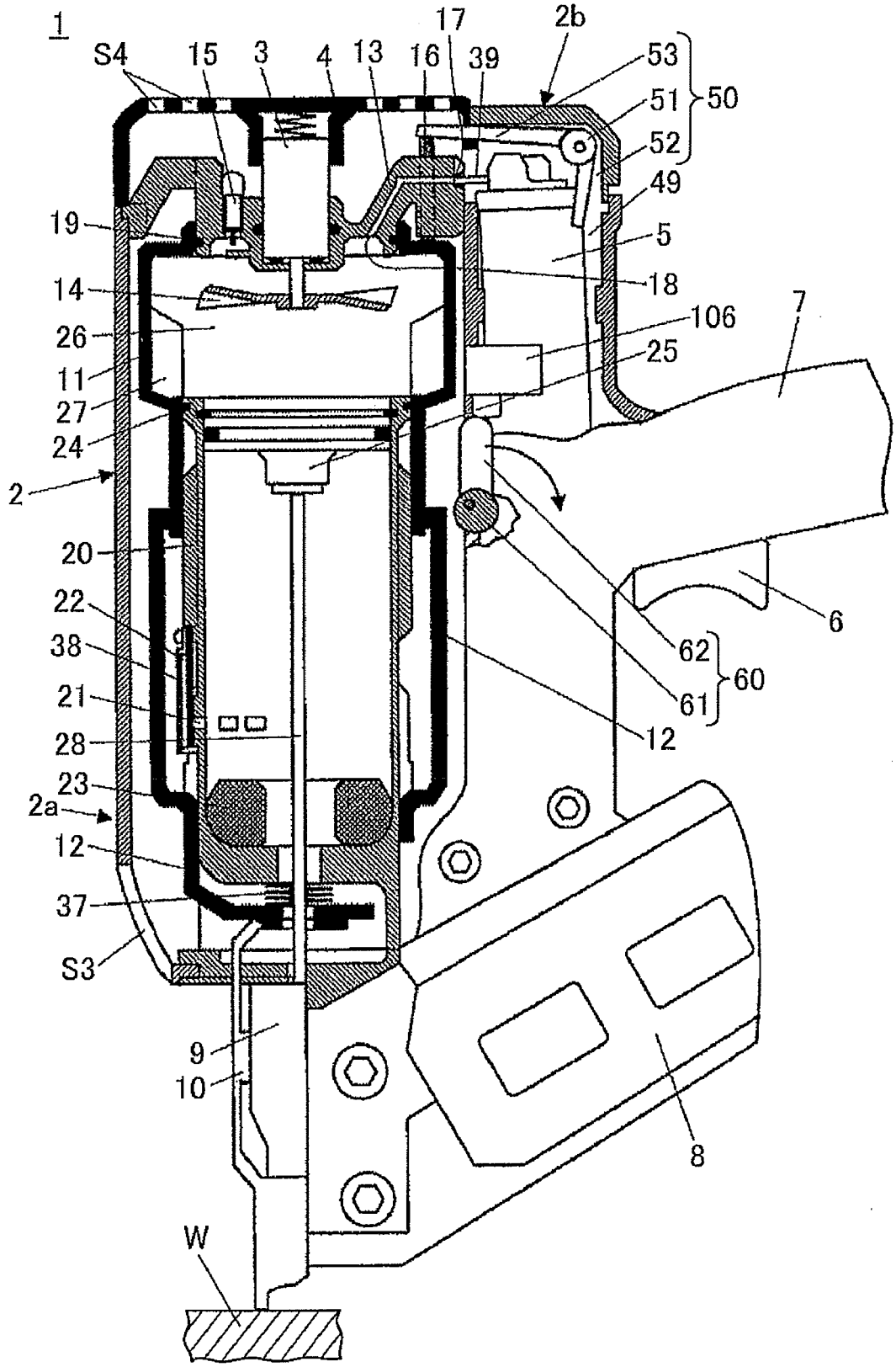
FIG. 2 is a schematic cross-sectional view of the combustion type power tool according to the embodiment, and particularly showing the release position of the stop unit.

Hence, when a user pushes the housing 2 to the workpiece W, with the distal end of the push lever 10 abutting on the workpiece W, the upper end of the push lever 10 moves upward in the main housing section 2*a* as shown in FIG. 2, against the biasing force of the compression coil spring 37. The coupling member 12 therefore moves the combustion chamber frame 11 upward toward the chamber head 13. Thus, the combustion chamber frame 11 eventually abuts on the chamber head 13. As a result, the chamber head 13, the combustion chamber frame 11 and an upper surface of the piston 25 define a combustion chamber 26 as shown in FIG. 2.

A first seal member 19 in the form of an O-ring is assembled on the chamber head 13 for maintaining sealing between the chamber head 13 and the combustion chamber frame 11 as long as the upper end of the combustion chamber frame 11 abuts on the chamber head 13. Further, a second seal member 24 in the form of an O-ring is assembled on the upper end portion of the cylinder 20 for maintaining sealing between the inner peripheral surface of the lower part of the combustion chamber frame 11 and the outer peripheral surface of the upper end portion of the cylinder 20 as long as the upper end of the combustion chamber frame 11 abuts on the chamber head 13.

As described above, the upper end of the combustion chamber frame 11 abuts on the lower end of the chamber head 13, defining the combustion chamber 26, when the combustion chamber frame 11 moves upwards as the push lever 10 is pushed. Almost at the same time, the projecting member 16 moves through the through-hole of the chamber head 13 and abuts on the second arm 53 of the L-shaped lever 50. As a result, the first arm 52 pushes the upper part of the outer circumferential surface of the canister 5. Thus, the combustible gas is injected from the injection nozzle 39 into the combustion chamber 26.

The cylinder 20 has a lower end portion formed with a gas vent hole 21 in communication with an exhaust opening S3 formed in the main housing section 2*a*. An exhaust gas check valve 22 is disposed over the gas vent hole 21 to allow exhaust gas to flow from an inner cylindrical space of the cylinder 20 to the outside of the cylinder 20. An exhaust cover 38 is disposed over the check valve 22 for directing the exhaust gas discharged through the gas vent hole 21 along the axial direction of the cylinder 20, thus changing the flowing direction of the exhaust-gas. Until a predetermined time elapses after the explosion of combustion gas, the combustion chamber frame 11 remains in abutment with the chamber head 13.

After the combusted gas is exhausted, the exhaust gas check valve 22 is closed to again seal the combustion chamber 26 and the temperature drop in the combustion chamber 26 occurs. Thus, the pressure in the combustion chamber 26 is reduced (a so-called "thermal vacuum" is generated). Accordingly, the piston 25 can moves up, returning to its top dead center, because of the pressure difference between the space above the piston 25 and the space below the piston 25.

As described above, the chamber head 13, the combustion chamber frame 11, the upper portion of the cylinder 20, the top surface of the piston 25, the first seal member 19 and the second seal member 24 define the combustion chamber 26 when the upper end of the combustion chamber frame 11 abuts on the chamber head 13. Conversely, when the combustion chamber frame 11 moves downward leaving the chamber head 13, a first passage S1 and a second passage S2 are provided. The first passage S1 is open to the atmosphere and is provided between the chamber head 13 and the combustion chamber frame 11. The first passage S1 serves as an intake passage for introducing an external air. The second passage S2 is in communication with the first passage S1 and is provided between the lower end portion of the combustion chamber frame 11 and the upper end portion of the cylinder 20. The second passage S2 allows the combusted gas or fresh air to pass along the outer peripheral surface of the cylinder 20 to perform discharge of the combusted gas through the exhaust opening S3.

A plurality of ribs 27 are provided on a part of the combustion chamber frame 11, the part defining the combustion chamber 26. The ribs 27 extend in the axial direction of the combustion chamber frame 11 and protrude radially inwardly in the combustion chamber frame 11. When the fan 14 is rotated, the ribs 27 promotes mixing of the fresh air and the combustible gas supplied from the gas canister 5 in the combustion chamber 26 in cooperation with the rotation of the fan 14. The head cover 4 has an intake opening S4 for supplying fresh air into the combustion chamber 26. Combusted gas is discharged outside through the gas vent hole 21 and the exhaust opening S3.

The driver blade 28 is coaxial with the nail set in the tail cover 9. When the piston 25 moves downward, the driver blade 28 also moves downwards in its axial direction to strike the nail. In this instance, the piston 25 abuts on the above-mentioned bumper 23 and stops.

The fan 14, ignition plug 15 and gas injection port 18, all provided on and in the chamber head 13, are arranged or open in the combustion chamber 26 that is defined as the combustion chamber frame 11 moves upward. While the combustion chamber frame 11 is abutting on the chamber head 13, the fan 14 rotates to perform three functions. First, the fan 14 stirs and mixes air and combustible gas together before the ignition. Second, the fan 14 causes a turbulent combustion after the ignition, thereby promoting the combustion. Third, the combusted gas in the combustion chamber 26 can be scavenged and the combustion chamber frame 11 and cylinder 20 are cooled when the combustion chamber frame 11 leaves the chamber head 13 with providing the first passage S1 and the second passage S2.

Next, a configuration of a stop unit 60 will be described. the stop unit 60 is provided for selectively preventing the combustion chamber frame 11 from moving toward the chamber head 13 from a predetermined position in order to deactivate the L-shaped lever 50 to thus avoid wasteful gas injection.

That is, the stop unit 60 is provided to the housing 2 at a position in selective association with the coupling member 12. The stop unit 60 includes a projecting part 61 and a lever part 62. The projection part 61 has a circular shape, and a rotational center is deviated from a center of the circle. Thus, the projecting part 61 is projectable inward to abut against an upper end of the coupling member 12, and is retractable away from the upper end of the coupling member 12 depending on angular rotation angle of the projection part 61. The lever part 62 is fixed to the projecting part 61.

As long as the lever part 62 remains at a stop position (first position) as shown in FIG. 1, the projecting part 61 protrudes above the upper end of the coupling member 12, preventing the coupling member 12 from further moving upwards. On the other hand, when the lever part 62 shown in FIG. 1 is pivotally moved by 90° in counterclockwise direction, the projecting part 61 is switched to a release position (second position), thus releasing the coupling member 12 from a locked state as shown in FIG. 2. That is, once the lever part 62 is pivotally moved to the releasing position as shown in FIG. 2, the projecting part 61 no longer hold or contact the coupling member 12, allowing the coupling member 12 to move to a predetermined upper position. Thus, the projecting part 61 of the stop unit 60 can be moved between the stop position and the release position if the user pivotally moves the lever part 62. With this arrangement, the stop unit 60 prevents a wasteful injection of the combustible gas from the gas canister 5, when the push lever 10 is unintentionally or accidentally operated.

In the above-described embodiment shown in FIGS. 1 and 2, the circular projecting part 61 is rotatable around an eccentric axis. Nonetheless, the projecting part 61 may have any other shape as long as the part 61 can prevent the coupling member 12 from moving upwards when the lever part 62 remains at the stop position. Further, in the above-described embodiment, the stop unit 60 is of a rotary type and thus switched between the stop position and the release position. However, instead of the rotary type, a push type stop unit can be used which is operated like a push switch to be switched between the stop position and the release position. Alternatively, a sliding type stop unit can also be used.

Next, an electrical circuit including a power switch in the above-described embodiment will be described. In the present embodiment, operation of a power switch 106 is interlocked with the operation of the stop unit 60. As shown in FIG. 3, the power switch 106 is provided in a power-supplying circuit that is incorporated in an ignition control device 110.

Figure 3:
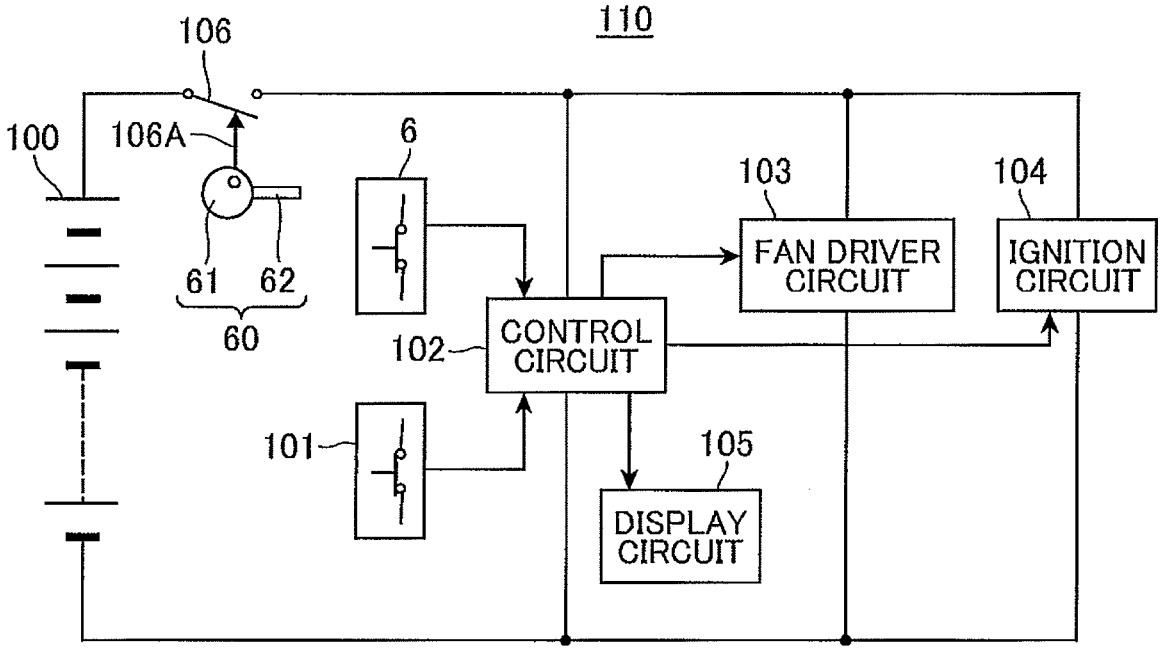
FIG. 3 is a block diagram of an ignition control device used in the embodiment of the invention.
Figure 4:
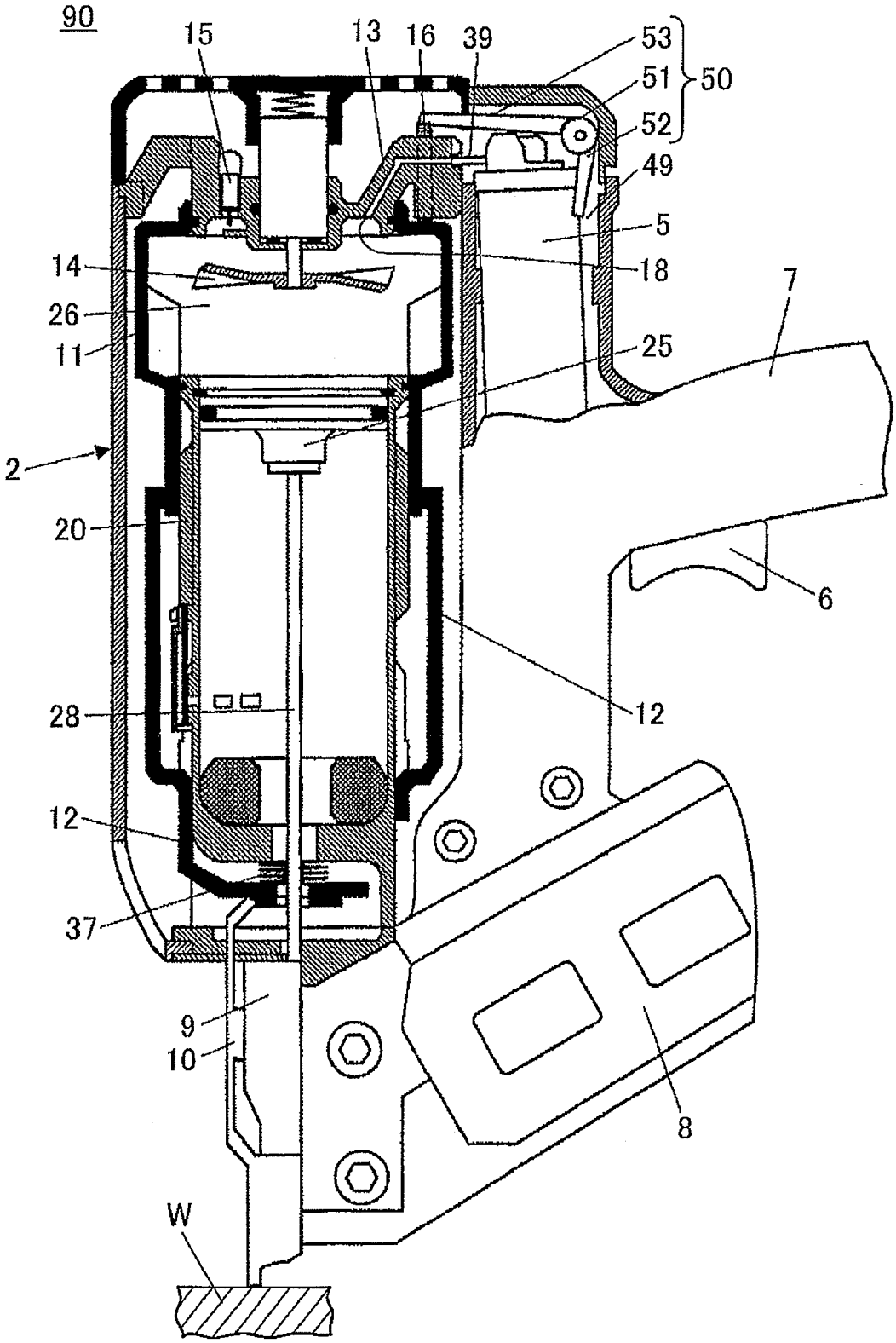
FIG.4 PRIOR ART
FIG. 4 is a schematic cross-sectional view of a conventional combustion type power tool.

In FIG. 3, the ignition control device 110 includes a control circuit 102 adapted for receiving on/off signals from the trigger switch 6 and head switch 101. The device 110 further includes a fan driver circuit 103, an ignition circuit 104 and a display circuit 105, all electrically connected to an output side of the control circuit 102. The control circuit 102 controls these circuits 103, 104 and 105. The fan driver circuit 103 drives the fan motor 3 for driving the fan 14. The ignition circuit 104 makes the ignition plug 15 generate a spark. The display circuit 105 monitors the on/off states of the trigger switch 6 and head switch 101 and a set condition of a battery 100. Power supply from the battery 100 to the control circuit 102, fan driver circuit 103 and ignition circuit 104 is performed through the power switch 106 (main switch). Hence, application of unnecessary electric currents from the battery to the above-described various components in the ignition control device 110 can be shut off while the power tool is left unused. The battery 100 and the ignition control device 110 are disposed in the handle 7 though not illustrated in FIGS. 1 and 2.

On/off operation of the power switch 106 is interlocked with the angular position of the stop unit 60 as shown in FIG. 3. That is, the power switch 106 electrically disconnects the control circuit 102 from the battery 100 as long as the stop unit 60 remains at the stop position (first position). Conversely, the power switch 106 electrically connects the control circuit 102 to the battery 100 as long as the stop unit 60 remains at the release position (second position). The switch 106 can avoid wasteful battery-power consumption even if the battery 100 remains set, provided that the stop unit 60 is held at the "stop position". To use the combustion type power tool 1, the user moves the stop unit 60 to the "release position". Then, the power switch 106 is turned on, and the tool 1 can be operated.

A rotary switch is used as the power switch 106 switchable in interlocking relation to the "stop position" and the "release position" of the stop unit 60. A switch arm 106A is axially movable following an outer contour of the is projection part 61. If the stop unit 60 is at its stop position, the switch arm 106A is moved upward in FIG. 3 to close the power switch 106. Other type of power switch is available. For example, a push-button type power switch is available if the push type stop unit is used, and a sliding type power switch is available if slide type stop unit is used.

Operation of the nail gun 1 will next be described. In a non-operational phase of the nail gun 1, the user pivotally moves the lever part 62 of the stop unit 60 to the stop position (horizontal position) as illustrated in FIG. 1, so that the projecting part 61 abuts on an end e.g., a shoulder of the coupling member 12. As long as the projecting part 61 keeps abutting on the coupling member 12, the push lever 10 cannot move up the coupling member 12 or the combustion chamber frame 11 even if the user unintentionally holds the handle 7 and presses the push lever 10 to the workpiece W. Therefore, the projecting member 16 protruding from the upper end of the combustion chamber frame 11 cannot move upwards. Accordingly, the projecting member 16 cannot abut on the second arm 53 to pivotally move the L-shaped lever 50. Thus, the first arm 52 of the L-shaped lever 50 does not move to push the gas canister 5 toward the chamber head 13. Hence, no combustible gas is injected from the injection nozzle 39. This avoids unnecessary injection of the combustible gas.

For operating the nail gun 1, the user pivotally moves the lever part 62 to the release position (vertical position) as illustrated in FIG. 2, maintaining the projecting part 61 of the stop unit 60 at a position away from the shoulder of the coupling member 12. When the user holds the handle 7 and presses the push lever 10 to the workpiece W, the push lever 10 pushes the coupling member 12 and the combustion chamber frame 11 upwards as shown in FIG. 2.

When the coupling member 12 and the combustion chamber frame 11 reach a predetermined position, the flow passages S1 and S2 are closed as shown in FIG. 1. Thus, sealed combustion chamber 26 is provided by the seal members 19 and 24. As the combustion chamber frame 11 further moves upwards, the projecting member 16 protruding from the upper end of the combustion chamber frame 11 abuts on the second arm 53 and pushes the second arm 53 upwards, whereupon the L-shaped lever 50 is pivotally moved, so that the first arm 52 pushes the gas canister 5 toward the chamber head 13 (toward the injection nozzle 39). The combustible gas in the gas canister 5 is thereby injected only once and in a prescribed amount from the injection nozzle 39. The combustible gas is supplied through the gas injection port 18 into the combustion chamber 26. The combustion chamber 26 is therefore filled with the combustible gas.

When the combustion chamber frame 11 further moves to a position near its uppermost stroke end as the push lever 10 moves, the head switch 101 (FIG. 3) is turned on. As a result, the fan 14 starts rotating in the sealed combustion chamber 26. In cooperation with the ribs 27, the fan 14 stirs and mixes the injected combustible gas and air in the combustion chamber 26, forming air-fuel mixture.

When the combustion chamber frame 11 reaches the uppermost stroke end and the trigger switch 6 of the handle 7 is pulled, the ignition plug 15 generates a spark, igniting the air-fuel mixture. At this time, the fan 14 keeps rotating, promoting the turbulent combustion of the air-fuel mixture. This increases the output of the nail gun 1. Upon combustion and explosion, the piston 25 is pushed downwards. Until the piston 25 abuts on the bumper 23, the driver blade 28 drives a nail in the tail cover 9 into the workpiece W.

As the piston 25 moves down and moves past the gas vent hole 21 of the cylinder 20, the pressure of the combusted gas pushes the exhaust gas check valve 22 to open the gas vent hole 21. The combusted gas is discharged outside from the cylinder 20 and is discharged to the atmosphere through the exhaust opening S3 of the main housing section 2*a*. The exhaust gas check valve 22 is closed when the pressure in the cylinder 20 and combustion chamber 26 falls to the atmospheric pressure. The combusted gas remaining in the cylinder 20 and combustion chamber 26 is at a high temperature immediately after the combustion. However, the combusted gas is rapidly cooled as the heat is absorbed into the mass of cylinder 20 and the mass of combustion chamber frame 11. Thus, the air pressure in the closed space above the piston 25 is reduced, and a so-called thermal vacuum is generated in that part of the combustion chamber 26 which lies above the piston 25 and the pressure in the combustion chamber becomes equal to or lower than the atmospheric pressure. The pressure (i.e., atmospheric pressure) in that part of the cylinder 20 which lies below the piston 25 and at the side of the driver blade 28 is higher than the pressure in that part of the cylinder 20 which lies above the piston 25 at the side of the combustion chamber 26. The piston 25 is therefore pushed back to the initial top dead center position.

In the present embodiment, the pressure in the combustion chamber 26 remains at a value equal to or smaller than the atmospheric pressure until the piston 25 returns to the top dead center. Therefore, the combustion chamber 26 is inhibited from being opened to the atmosphere as long as the trigger switch 6 remains on, even if the lower end of the push lever 10 leaves the workpiece W.

When the user lifts the nail gun 1 from the workpiece W, thus leaving the push lever 10 from the workpiece W, and turns off the trigger switch 6, the push lever 10 and the combustion chamber frame 11 return to their lower positions by virtue of the biasing force of the compression coil spring 37, so that the flow passages S1 and S2 are formed. The passage S1 serves as an intake path to the combustion chamber 26 while the fan 14 keeps rotating. The passage S2 serves as an exhaust path from the combustion chamber 26. As a result, the residual combusted gas is expelled from the combustion chamber 26 and fresh air flows into the combustion chamber 26, i.e., scavenging can be performed. Thus, the nail gun 1 can restore a state for subsequent nail driving operation.

To set the nail gun 1 to the inoperative state, the user pivotally moves the lever part 62 of the stop unit 60 from the release position (vertical position) back to the stop position (horizontal position) as is illustrated in FIG. 1. The projecting part 61 of the stop unit 60 therefore is brought into abutment with the shoulder of the coupling member 12. When the stop unit 60 is switched to the stop position, any unintentional upward motion of the push lever 10 can be prevented as described above. At the same time, the power switch 106 is interlockingly held into an open state to stop a power supply from the battery 100 to the ignition control device 110 (FIG. 3). Thus, wasteful battery-power consumption can be avoided even if the battery 100 remains set in the tool 1.

In view of the foregoing, in the nail gun according to the above-described embodiment, wasteful consumption of gas can be avoided even if the push lever is unintentionally or accidentally operated. This helps to save resources and enhance the safety. Further, operability can be improved because the user need not set the gas canister in the nail gun before using the gun or remove the canister after using the gun.

Further, wasteful consumption of battery power can be avoided to save resources and enhance the safety. Further, no control current is supplied to monitor the standby state of the trigger switch or head switch as long as the stop unit has the stop position. In addition, troublesome work such as setting the battery before using the gun or removing the same after using the gun can be eliminated. Further, over-discharging of the battery can be avoided, thereby prolonging service life of the battery. The battery can be a lithium-ion secondary battery, as well as a nickel-cadmium secondary battery.

While the invention has been described in detail and with reference to specific embodiment thereof, it would be apparent to those skilled in the art that various changes and modifications may be made therein without departing from the scope of the invention. For example, in the embodiment described above, the projecting part 61 of the stop unit 60 is made to abut on the coupling member 12. Instead, the stop unit 60 can abut on any one of the push lever 10, the combustion chamber frame 11, the L-shaped lever 50 and the gas canister 5 to prevent the coupling member 12 from moving so as to obviate the injection from the injection nozzle 39.

INDUSTRIAL APPLICABILITY

The present invention is available for various kinds of combustion type power tool such as a nail gun or the like.

The invention claimed is:

1. A combustion type power tool comprising:

a housing including a canister housing in which a gas canister accumulating a gas is provided;

a push lever supported to the housing;

a combustion chamber frame disposed in the housing and movable in accordance with a movement of the push lever;

a drive mechanism provided in the housing for driving the pas canister to inject the gas when the combustion chamber frame is moved to a predetermined position; and a prohibiting mechanism disposed at the housing and selectively providing a prohibiting position to prevent the combustion chamber frame from moving past the predetermined position and a non-prohibiting position to allow the combustion chamber frame to move past the predetermined position;

wherein the push lever is movable in a first direction toward a workpiece and a second direction opposite to the first direction, the combustion type power tool further comprising:

a chamber head forming therein a gas injection passage, the gas canister being in selective fluid communication with the gas injection passage;

a cylinder disposed in the housing and below the chamber head and extending in a longitudinal direction of the housing;

a piston slidably movably disposed in the cylinder, a combustion chamber being defined in combination with the combustion chamber frame, the chamber head, the cylinder and the piston when the combustion chamber frame is seated on the chamber head through the movement of the combustion chamber in the second direction; and a coupling member that connects the push lever to the combustion chamber frame for moving the combustion chamber frame to a position in abutment with the chamber head in interlocking relation to the movement of the push lever into the housing;

wherein the prohibiting mechanism has a stop position in the prohibiting position to prevent the coupling member from moving in the second direction, and has a release position in the non-prohibiting position to allow the coupling member to move in the second direction.

2. The combustion type power tool as claimed in claim 1, wherein the prohibiting mechanism comprises:

a projection part pivotally supported to the housing and movable between a projecting position abutable on the coupling member and retracted position away from the coupling member; and a lever part connected to the projection part and accessible by a user for pivotally moving the projection part between the projecting position and the retracted position.

3. The combustion type power tool as claimed in claim 1, wherein the drive mechanism comprises:

a projection member extending from the combustion chamber frame toward the chamber head, the projection member being movable in the first direction and second direction in accordance with the movement of the combustion chamber frame;

an L-shaped lever pivotally movably supported to the housing and having a first arm for urging the gas canister to a position of the gas injection phase and a second arm integral with the first arm and associated with the projection member, the projection member being maintained away from the second arm when the prohibiting mechanism has the stop position, and being abutable on the second arm when the prohibiting mechanism has the release position.

4. A combustion type power tool comprising:

a housing including a canister housing in which a gas canister accumulating a gas is provided;

a push lever supported to the housing;

a combustion chamber frame disposed in the housing and movable in accordance with a movement of the push lever;

a drive mechanism provided in the housing for driving the gas canister to inject the gas when the combustion chamber frame is moved to a predetermined position; and a prohibiting mechanism disposed at the housing and selectively providing a prohibiting position to prevent the combustion chamber frame from moving past the predetermined position and a non-prohibiting position to allow the combustion chamber frame to move past the predetermined position;

wherein the push lever is movable in a first direction toward a workpiece and a second direction opposite to the first direction, the combustion type power tool further comprising:

a chamber head forming therein a gas injection passage, the gas canister being in selective fluid communication with the gas injection passage, a combustion chamber being defined when the combustion chamber frame is seated on the chamber head through the movement of the combustion chamber frame in the second direction;

an ignition plug supported in the chamber head for igniting a combustible gas injected from the gas canister into the combustion chamber;

an ignition control circuit connected to the ignition plug and including a power switch and a power source section;

an interlocking mechanism connected between the prohibiting mechanism and the power switch for maintaining the power switch in OFF state in interlocking relation to the prohibiting position.

5. The combustion type power tool as claimed in claim 4, further comprising:

a coupling member that connects the push lever to the combustion chamber frame for moving the combustion chamber frame to a position in abutment with the chamber head in interlocking relation to the movement of the push lever into the housing.

6. The combustion type power tool as claimed in claim 5, wherein the prohibiting mechanism has a stop position in the prohibiting position to prevent the coupling member from moving in the second direction, and has a release position in the non-prohibiting position to allow the coupling member to move in the second direction.

7. The combustion type power tool as claimed in claim 6, wherein the prohibiting mechanism comprises:

a projection part pivotally supported to the housing and movable between a projecting position abutable on the coupling member and retracted position away from the coupling member; and a lever part connected to the projection part and accessible by a user for pivotally moving the projection part between the projecting position and the retracted position.

8. The combustion type power tool as claimed in claim 5, wherein the drive mechanism comprises:

a projection member extending from the combustion chamber frame toward the chamber head, the projection member being movable in the first direction and second direction in accordance with the movement of the combustion chamber frame;

an L-shaped lever pivotally movably supported to the housing and having a first arm for urging the gas canister to a position of the gas injection phase and a second arm integral with the first arm and associated with the projection member, the projection member being maintained away from the second arm when the prohibiting mechanism has the stop position, and being abutable on the second arm when the prohibiting mechanism has the release position.

9. A combustion type power tool comprising:

a housing including a canister housing in which a gas canister is provided;

a push lever supported in the housing and movable in a first direction toward a workpiece and a second direction opposite to the first direction;

a combustion chamber frame disposed in the housing and movable in the first direction and the second direction in accordance with a movement of the push lever;

a chamber head forming therein a gas injection passage, the gas canister being in selective fluid communication with the gas injection passage, a combustion chamber being defined when the combustion chamber frame is seated on the chamber head through the movement of the combustion chamber frame in the second direction;

an ignition plug supported in the chamber head for igniting a combustible gas injected from the gas canister into the combustion chamber;

an ignition control circuit connected to the ignition plug and including a power switch and a power source section;

a prohibiting mechanism disposed at the housing and selectively providing a prohibiting position to prevent the combustion chamber frame from moving past a predetermined position through the movement of the combustion chamber frame in the second direction and a non-prohibiting position to allow the combustion chamber frame to move past the predetermined position through the movement of the combustion chamber frame in the second direction; and an interlocking mechanism connected between the prohibiting mechanism and the power switch for maintaining the power switch in OFF state in interlocking relation to the prohibiting position.

10. A combustion type power tool comprising:

a housing including a canister housing in which a gas canister is provided;

a push lever supported in the housing and movable in a first direction toward a workpiece and a second direction opposite to the first direction;

a combustion chamber frame disposed in the housing and movable in the first direction and the second direction in accordance with a movement of the push lever;

a chamber head forming therein a gas injection passage, the gas canister being in selective fluid communication with the gas injection passage, a combustion chamber being defined when the combustion chamber frame is seated on the chamber head through the movement of the combustion chamber frame in the second direction;

an ignition plug supported in the chamber head for igniting a combustible gas injected from the gas canister into the combustion chamber;

an ignition control circuit connected to the ignition plug and including a power switch and a power source section;

a prohibiting mechanism disposed at the housing and selectively providing a prohibiting position to prevent the combustion chamber frame from moving past a predetermined position through the movement of the combustion chamber frame in the second direction and a non-prohibiting position to allow the combustion chamber frame to move past the predetermined position through the movement of the combustion chamber frame in the second direction.

* * * * *